US007503818B1

(12) United States Patent
Hagan

(10) Patent No.: US 7,503,818 B1
(45) Date of Patent: Mar. 17, 2009

(54) PROPULSION SYSTEM FOR A SHIP OR SEAGOING VESSEL

(76) Inventor: James Hagan, 18728 Santa Carmela, Fountain Valley, CA (US) 92708

( * ) Notice: Subject to any disclaimer, the term of this patent is extended or adjusted under 35 U.S.C. 154(b) by 0 days.

(21) Appl. No.: 11/895,106

(22) Filed: Aug. 23, 2007

(51) Int. Cl.
*B63H 5/10* (2006.01)

(52) U.S. Cl. ..... 440/81; 440/82; 440/61 T

(58) Field of Classification Search ..... 440/53, 440/61 T, 82, 83, 81, 75
See application file for complete search history.

(56) References Cited

U.S. PATENT DOCUMENTS

| | | | | |
|---|---|---|---|---|
| 1,595,949 | A | 8/1926 | Kirin | |
| 1,813,552 | A | 7/1931 | Stechauner | |
| 1,910,561 | A | 5/1933 | Pierce | |
| 2,691,356 | A | 10/1954 | Waterval | |
| 3,938,464 | A * | 2/1976 | Gill | 440/80 |
| 4,619,584 | A | 10/1986 | Brandt | |
| 4,645,463 | A | 2/1987 | Arneson | |
| 4,747,795 | A * | 5/1988 | Kawamura et al. | 440/75 |
| 4,790,782 | A | 12/1988 | McCormick | |
| 4,840,136 | A | 6/1989 | Brandt | |
| 4,887,983 | A | 12/1989 | Bankstahl et al. | |
| 4,932,907 | A | 6/1990 | Newman et al. | |
| 5,009,621 | A | 4/1991 | Bankstahl et al. | |
| 5,376,031 | A | 12/1994 | Meisenburg et al. | |
| 5,376,034 | A | 12/1994 | Meisenburg et al. | |
| 5,575,698 | A | 11/1996 | Ogino | |
| 5,759,073 | A | 6/1998 | Sambino et al. | |
| 5,766,047 | A | 6/1998 | Alexander, Jr. et al. | |
| 5,800,223 | A | 9/1998 | Iriono et al. | |
| 5,807,151 | A | 9/1998 | Sumino | |
| 6,821,169 | B2 | 11/2004 | Jordan | |
| 6,899,576 | B2 | 5/2005 | Reuter et al. | |

* cited by examiner

*Primary Examiner*—Stephen Avila
(74) *Attorney, Agent, or Firm*—Gene Scott; Patent Law & Venture Group

(57) ABSTRACT

A marine drive is engaged with and is driven by a vessel's engine drive shaft. The drive includes: a universal joint secured to the vessel's hull; a first screw shaft supporting a first screw; a first gear set driven by the first screw shaft; a second screw shaft driven by the first gear set; a second gear set driven by the second screw shaft; a third screw shaft driven by the second gear set and supporting a second screw; and a third screw supported by the second screw shaft at its terminal end. The first and second gear sets are enclosed within a water-tight enclosure enabling rotational speed differentiation between the first and second screw shafts and enabling rotational sense reversal between the second and third screw shafts. An actuator provides changes in angle of attack of the second and third screws.

12 Claims, 3 Drawing Sheets

PROPULSION SYSTEM FOR A SHIP OR SEAGOING VESSEL

CROSS-REFERENCE TO RELATED APPLICATIONS

Figure 1:
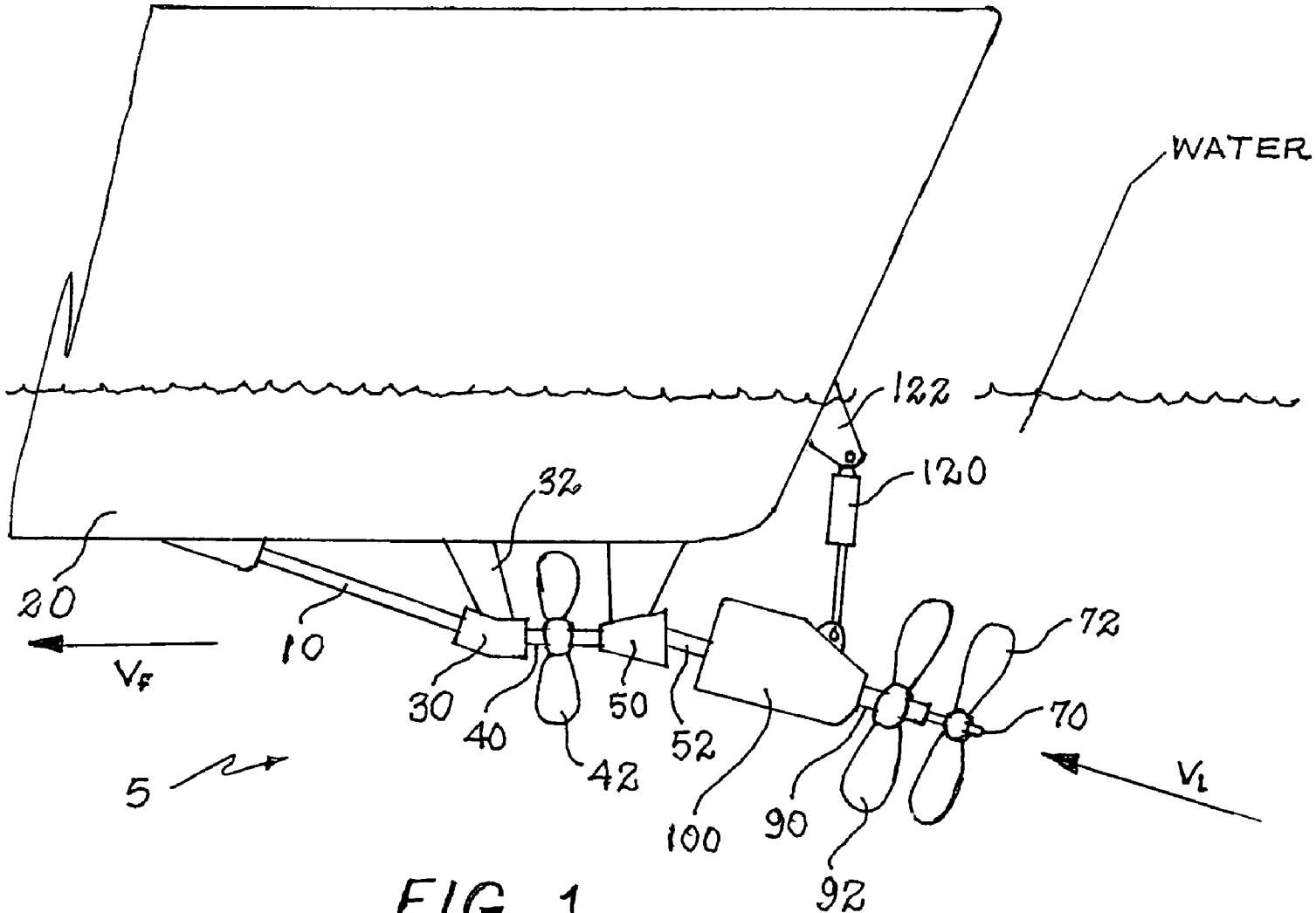

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to marine drives, and more particularly to a marine drive capable of efficiently converting the output of powerful marine engines to forward thrust, to provide rotational speed differentials between plural screws driven by a single engine shaft, and to provide variable thrust vector angle of attack.

2. Description of Related Art including information disclosed under 37 CFR 1.97 and 1.98

Kirin, U.S. Pat. No. 1,595,949, discloses a boat comprising a hull having a cylindrical portion and keel supported centrally upon the under side thereof; side fins arranged upon the opposite and extending downwardly and oppositely and obliquely disposed upon the opposite sides of the keel for eliminating the upper locking and rolling effect of water craft, a drive shaft mounted within the cylindrical member and having propulsion conical-shaped members arranged in like end to end relation upon the opposite ends of the drive shaft exteriorly of the cylindrical portion, and the outer sides of the conical-shape members having helically and spiraled positioned plates radiating from the apex of the conical-shaped members and rearwardly in spaced relation to the periphery thereof to whereby the particular water craft may be propelled and impelled from both ends of the craft in a single operation upon the common drive shaft.

Pierce, U.S. Pat. No. 1,910,561, discloses an outboard motor, in combination, a housing enclosing a vertically disposed power shaft, the housing being rotatable about a vertically disposed line, a horizontally disposed propeller shaft disposed at the lower end of the propeller shaft and operatively connected thereto for driving movement therefrom, the propeller shaft projecting both forwardly and rearwardly from the housing, a propeller secured to the propeller shaft forwardly of the housing, and a propeller secured to the propeller shaft rearwardly of the housing, the last mentioned propeller having a greater pitch than the first mentioned propeller.

Stechauner, U.S. Pat. No. 1,813,552, discloses a propelling mechanism, the combination with an underwater housing, of a power transmission shaft journalled in the housing and extending lengthwise thereof and provided with a bevel gear, a sleeve shaft extending at right angles to the first named shaft and journalled in one end of the housing and provided with a bevel gear meshing with the first named gear and having a shoulder exterior of the housing, a propeller mounted on the second sleeve shaft and abutting the shoulder, a third shaft extending at right angles to the first shaft and journalled in the housing and extending through the sleeve shaft and provided with a bevel gear meshing with the first named bevel gear, and a propeller mounted on the outer end of the third shaft, the propellers being of substantially similar pitch ratio and size but of opposite pitch and mounted adjacent each other, the second and third named bevel gears being disposed on opposite sides of the first named bevel gear and being of the same pitch diameter.

Waterval, U.S. Pat. No. 2,691,356, discloses a multiple propeller drive for ships comprising in combination, a ship's hull having an opening therein, a block member mounted inside the hull, a casing supported by the block member, a shaft journalled in the casing, a pulley mounted on the shaft, a coupling at one end of the latter adapted to connect the shaft to a power unit, a strut secured to the hull, a second casing integral with the lower end of the strut, a second shaft having a propeller at each end thereof, and being mounted in the second casing, a second pulley arranged on the second shaft, and a belt mounted on the first and second pulley and adapted to actuate the second shaft, guides for the first shaft and being attached to the end of the first casing; bearing blocks supporting the first shaft, and screws mounted in the latter for vertical movement, and handwheels threaded upon the screws, whereby to adjust the belt drive.

Arneson, U.S. Pat. No. 4,645,463, discloses a marine outdrive attachable to the transom of a boat having an inboard engine. The marine outdrive includes a tubular support casing securable to and extendable rearwardly of the boat's transom and having a ball socket at its rear end. The ball socket receives a ball at the front end of a tubular, propeller shaft carrier having a conical outer surface. A drive shaft connectable to the inboard engine is journalled in the support casing. A propeller shaft is journalled in the propeller shaft carrier and has a propeller mounted thereon at the rear end of the propeller shaft carrier. A universal joint couples the two shafts together, the center of such joint substantially coinciding with the point about which the ball pivots within the socket. Hydraulic steering cylinders are attached to the propeller shaft carrier to pivot the latter about a steering axis extending through the pivot point of the ball. A hydraulic trim cylinder extends between the transom and the propeller shaft carrier to swing the propeller shaft carrier about a laterally extending trim axis extending through the pivot point of the ball. The upper end of the trim cylinder is pivotally mounted on the transom at a location above and vertically aligned with the pivot point of the ball or at a location above and forwardly of such pivot point. Improved fins are provided on the propeller shaft carrier near the propeller to stabilize the boat. The drive shaft of the inboard motor can be directly connected to the joint or offset from the joint and coupled thereto by a vertically extending transmission.

McCormick, U.S. Pat. No. 4,790,782, discloses a marine stern drive for a boat that includes a propeller assembly having a carrier for a pair of concentric drive shafts to which are mounted a pair of closely adjacent fore and aft coaxial surface piercing propellers mounted on a common axis. The carrier also includes a downwardly extending skeg. The shafts are connected to a source of power and drive the propellers in contra-rotating relationship at essentially equal rotational velocities. The carrier is connected to devices for swinging the carrier laterally for steering, and also vertically. A control is provided for positioning and maintaining the carrier vertically such that both contra-rotating propellers are continuously disposed in surface piercing position during normal operation of the drive. The result is that lateral forces created on the propeller carrier by one rotating surface piercing propeller are counterbalanced by the other propeller when the skeg is parallel to the boat centerline. The leading edges of both propellers are relatively sharp for surface piercing, while the training edges of both propellers are relatively blunt.

Brandt, U.S. Pat. No. 4,840,136, discloses a double-propeller drive unit for boats, in which the under-water housing of the drive unit is designed so that the pressure center for the transverse force on the drive housing caused by water flow is located in front of the steering axis of the drive unit.

Brandt, U.S. Pat. No. 4,619,584, discloses a boat propeller drive with double, counter-rotating propellers that is distinguished by the after propeller having one more blade than the fore propeller as well as a smaller diameter than the fore propeller.

Bankstahl et al., U.S. Pat. No. 4,887,983, discloses a chain drive marine propulsion system that employs dual counterrotating propellers. The propellers are mounted to concentric propeller shafts disposed in the lower end of a depending gearcase. The concentric propeller shafts are each provided with a lower sprocket engaging a chain. A counterrotation mechanism is provided for driving the chains in opposite directions, thereby resulting in counterrotation of the propellers. Various embodiments for driving the chains in opposite directions are disclosed.

Newman et al., U.S. Pat. No. 4,932,907, discloses a marine propulsion system that includes a steerable lower gearcase portion and a drive mechanism including a chain drive for driving dual counterrotating propellers. The dual propellers are rotatably mounted to the lower steerable gearcase portion by means of inner and outer coaxially extending propeller shafts. A sprocket is mounted to each propeller shaft, and first and second chain portions extend between the propeller shaft sprockets and a pair of upper drive sprockets, preferably disposed above the water line during boat operation. Coaxially extending inner and outer drive shafts are interconnected with the engine output shaft, and are adapted for counterrotation in response to rotation thereof. The coaxial drive shafts are interconnected with the upper drive sprockets for driving such sprockets in opposite rotational directions, thereby resulting in movement of the first and second chain portions in opposite directions. The longitudinal axis of the inner and outer drive shafts defines the steering axis about which the lower steerable gearcase portion is pivotable.

Bankstahl et al., U.S. Pat. No. 5,009,621, discloses a dual counterrotating propeller drive mechanism for a marine propulsion system that incorporates a torque splitting device which consists of a differential gear means and a ratio gear means. The torque splitting device assigns a selectable fixed fraction of the engine torque to each propeller regardless of power, thrust, and speed conditions. The rear one of the two propellers adjusts its rotational speed relative to the front propeller in response to changes in the front propeller's wake and in this way maintains optimum propulsive efficiency over a wide range of operating conditions. Furthermore, precise matching of front and rear propeller parameters for a given application is no longer required.

Meisenburg et al., U.S. Pat. No. 5,376,031, discloses a marine drive has two counter-rotating surface operating propellers. The lower horizontal torpedo portion of the housing has an upper zone with outer surface profiles along horizontal cross-sections defining wedges with sharp leading tips forming a sharp leading edge for slicing through the water, the sharp leading tips defining the sharp leading edge defining a first line extending downwardly and rearwardly at a first angle relative to vertical. The torpedo portion has a lower zone with outer surface profiles along horizontal cross-sections defining wedges with sharp leading tips defining a second line extending downwardly and rearwardly at a second angle relative to vertical. The housing includes a skeg extending downwardly from the lower zone of the torpedo portion, the skeg having a leading edge defining a third line extending downwardly and rearwardly at a third angle relative to vertical. The third angle is greater than the first angle and less than the second angle. The first, second and third lines all intersect at the same point which point is on the rotational axis of the concentric counter-rotating propeller shafts.

Meisenburg et al., U.S. Pat. No. 5,376,034, discloses a surfacing marine drive that has a drive housing with a fore exhaust passage forward of the vertical bore housing the driveshaft, right and left exhaust passages extending rearwardly from the fore exhaust passage on opposite right and left sides of the vertical bore, and an aft exhaust passage extending rearwardly from the right and left exhaust passages and aft of the vertical bore and discharging exhaust into dual counter rotating surface operating propellers.

Ogino, U.S. Pat. No. 5,575,698, discloses a transmission for a counter-rotational propeller system of a watercraft outboard drive with an increased flow area for exhaust discharge behind the transmission within the lower unit. The transmission includes a pair of counter-rotating gears. A front clutch selectively drives an inner propulsion shaft by engaging the front gear. A rear clutch selectively drive an outer propulsion shaft by engaging either of the gears. The front clutch lies forward of the front gear and the rear clutch is interposed between the gears. The clutching mechanism thus entirely lies forward of the rear gear to provide more space for exhaust discharge flow behind the transmission.

Sambino et al., U.S. Pat. No. 5,759,073, discloses a propulsion system for a marine drive, which includes a pair of counter-rotating propellers, provides improved acceleration from idle or low speeds. Engine exhaust from an engine which powers the marine drive is conveyed to the water about each of the propellers. The exhaust gases aerate the water about each propeller to reduce drag resistance on each propeller. Several embodiments of the propulsion system are disclosed which convey the exhaust gases to both propellers for this purpose.

Alexander, Jr. et al., U.S. Pat. No. 5,766,047, discloses a twin propeller marine propulsion unit for a watercraft. A vertical drive shaft operably connected to the engine is journalled for rotation in a lower gear case and carries a beveled pinion that drives a pair of coaxial bevel gears. An inner propeller shaft and an outer propeller shaft are mounted concentrically in the lower torpedo-shaped section of the gear case and each propeller shaft carries a propeller. To provide forward movement for the watercraft, a sliding clutch, is moved in one direction to operably connect a first of the bevel gears with the inner propeller shaft to thereby drive the rear propeller. When the engine speed reaches a pre-selected elevated value, a hydraulically operated multi-disc clutch is actuated to operably connect the second of the bevel gears to the outer propeller shaft, to thereby drive the second propeller in the opposite direction. With this construction only a single propeller is driven at low engine speeds and the second propeller is driven when the engine speed reaches the pre-selected value.

Iriono et al., U.S. Pat. No. 5,800,223, discloses a marine propulsion device that improves the handling characteristics and the responsiveness of the watercraft on which it is used. The propulsion device includes a pair of counter-rotating propellers. At least the blades of the front propeller each have a mean camber line in cross-section which has a generally constant radius of curvature. This blade shape reduces cavitations and permits the rear propeller to be mounted closer to the front propeller, and consequently closer to the steering axis of the outboard drive. As a result, steering torque is reduced. The blades of the rear propeller also are not more than thirty percent smaller than the blades of the front propeller, and the average pitches of the propellers do not differ by more than one to four percent. These blade configurations of the front and rear propellers improve the stability of the watercraft when turning, thereby reducing chine walk, as well as improve the responsiveness of the watercraft.

Sumino, U.S. Pat. No. 5,807,151, discloses a blade design for a counter-rotating propeller system that improves the performance of the outboard drive on which is it employed when the propellers are run partially exposed. The propeller system includes a pair of counter-rotating propellers that rotate in opposite directions about a common axis. The rear propeller has a smaller diameter—about 92% of the front propeller—and a total blade face surface area of about 85% of the total blade face surface area of the front propeller. The blades of the front and rear propellers desirably have the same camber and generally the same pitch. The rear propeller pitch is between 90% and 110% of the front propeller pitch. These blade parameters improve the efficiency of the rear propeller over prior designs when the propellers run partially exposed in order to maximize the thrust produced by the propulsion system.

Jordan, U.S. Pat. No. 6,821,169, discloses a hybrid gear/sprocket-based transmission for driving a pair of coaxial, counter-rotating propellers in vessels. A drive shaft couplable to an engine crank shaft extends rearward into the transmission case, and a pair of coaxial driven shafts extend rearward out of the transmission case, to which are attachable a pair of propellers. A gear train, containing an even number of gears, reverses the rotational direction of the engine; a flexible member retains the rotational direction of the engine. Improved stability characteristics are imparted by supporting the drive shaft at two points and also by positioning the drive and the driven shafts in vertical alignment.

Reuter et al., U.S. Pat. No. 6,899,576, discloses a watercraft drive for a watercraft having front and rear propellers respectively mounted on a drive shaft in coaxial longitudinally displaced relationship, each of said propellers having at least two blades, the front and rear propellers having equal diameters and being driven at like rotational velocities. The central portion of the rear propeller up to a diameter equal to the diameter of the water jet arriving at the rear propeller, which due to the action of the front propeller has a contracted cross section, is designed to optimize the jet energy exiting the front propeller. The rear propeller has an annular area extending from the central portion to the outer circumference of the rear propeller, being designed with the same design as characterizes the front propeller. The annular area of the rear propeller receives a flow of surrounding ambient water.

The related art described above discloses outboard drives, L-drive arrangements and also near coaxial drive shaft-screw axis drives. Only the later is significant relative to the present disclosure. The former marine drive types generally provide a right angle drive train which is not of interest because of its relatively lower efficiency. However, Sage, U.S. Pat. No. 6,431,927, Arneson, U.S. Pat. No. 4,645,463, McCormick, U.S. Pat. No. 4,790,782 and Jordan, U.S. Pat. No. 6,821,169 all coaxial drives which are applicable to larger water craft such as yachts. All but McCormick also teach the use of a mechanism for adjusting the angle of attack of marine screws.

The present disclosure distinguishes over the prior art providing heretofore unknown advantages as described in the following summary.

BRIEF SUMMARY OF THE INVENTION

This disclosure teaches certain benefits in construction and use which give rise to the objectives described below.

Engines for small ships and yachts are able to generate significant thrust. However, prior art marine drives for ships and yachts are relatively inefficient with low speed and high fuel consumption. Such ships and yachts are most efficient at lower speeds where the hull is plowing. Incremental increases in screw RPM are not matched by equivalent incremental hull speeds. This is because, when plowing, a ship's hull must displace ever greater bow wave mass as speed increases and such mass increases non-linearly with hull speed. The present invention provides a solution to this problem enabling larger craft to move more quickly through the water while using relatively less fuel to do so.

By changing the angle of attack of a ship's drive screws the hull may be raised in the water so that it displaces less water and produces a smaller bow wave. To achieve greater screw thrust, dual in-line screws are used with counter-rotation to provide a significant improvement in thrust without producing undesirable screw steering effects. However, because a change in angle of attack of a ship's screws to provide hull lift is sub-optimal in producing forward thrust, the first effect tends to be negated by the second effect. To overcome this problem, the screws used for lift are able to be placed at an optimal angle for doing so, while a third screw is positioned for maximum forward thrust. To provide for simplicity and economy of enabling this capability, all three screws are driven by a single drive shaft. The present invention reduces fuel consumption while permitting relatively higher speeds in larger boats and yachts.

A primary objective inherent in the above described apparatus and method of use is to provide advantages not taught by the prior art.

Another objective is to provide a ship's drive having three coaxial screws that are driven from a single drive shaft.

Another objective is to provide such a ship's drive where, simultaneously, each screw may operate at a different rotational speed.

Another objective is to provide such a ship's drive capable of changing its angle of attack.

Another objective is to provide such a ship's drive wherein at least one of the screws does not change its angle of attack while, at the same time, at least one other of the screws does change its angle of attack.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Figure 2:
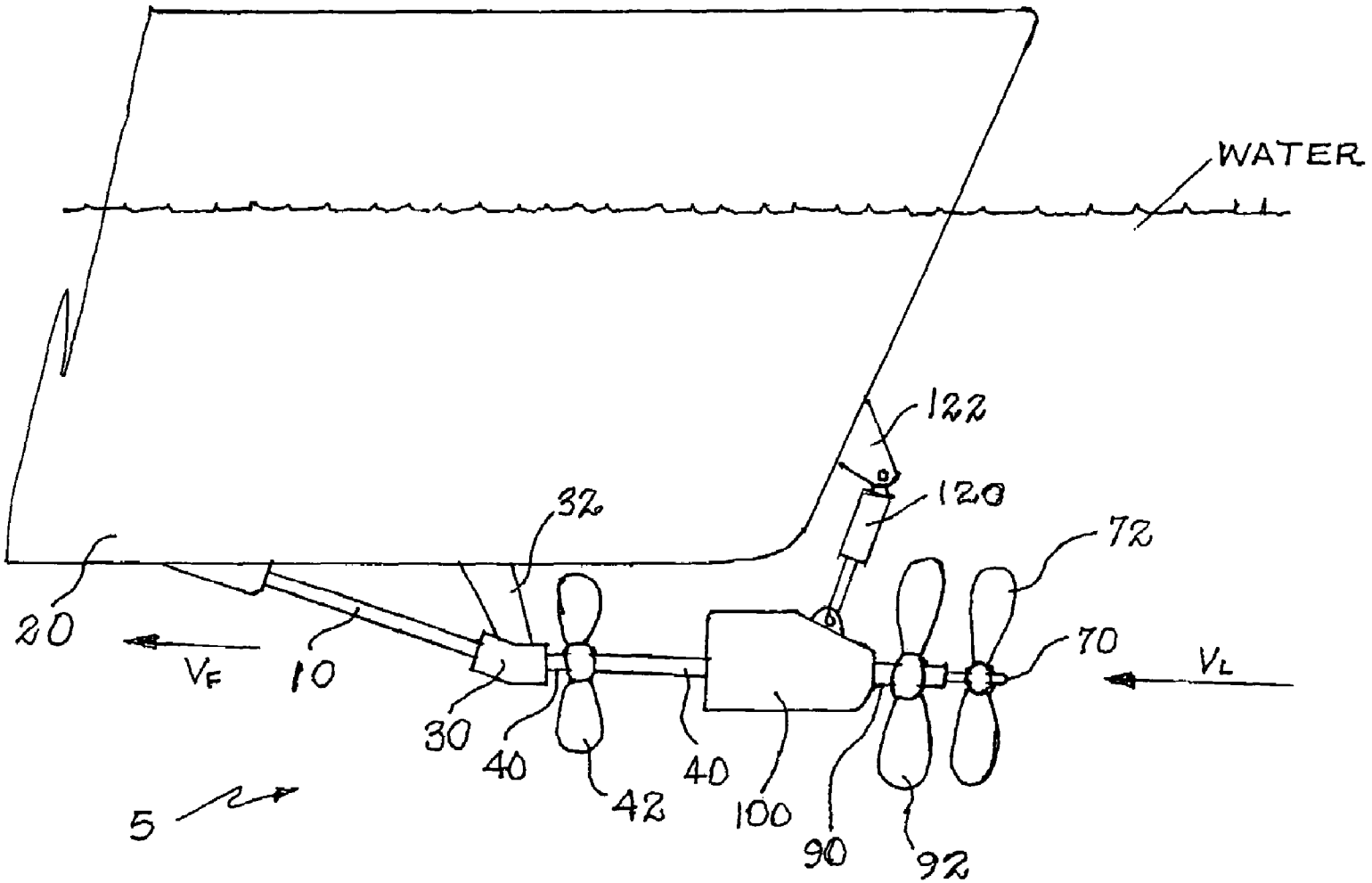
Figure 3:
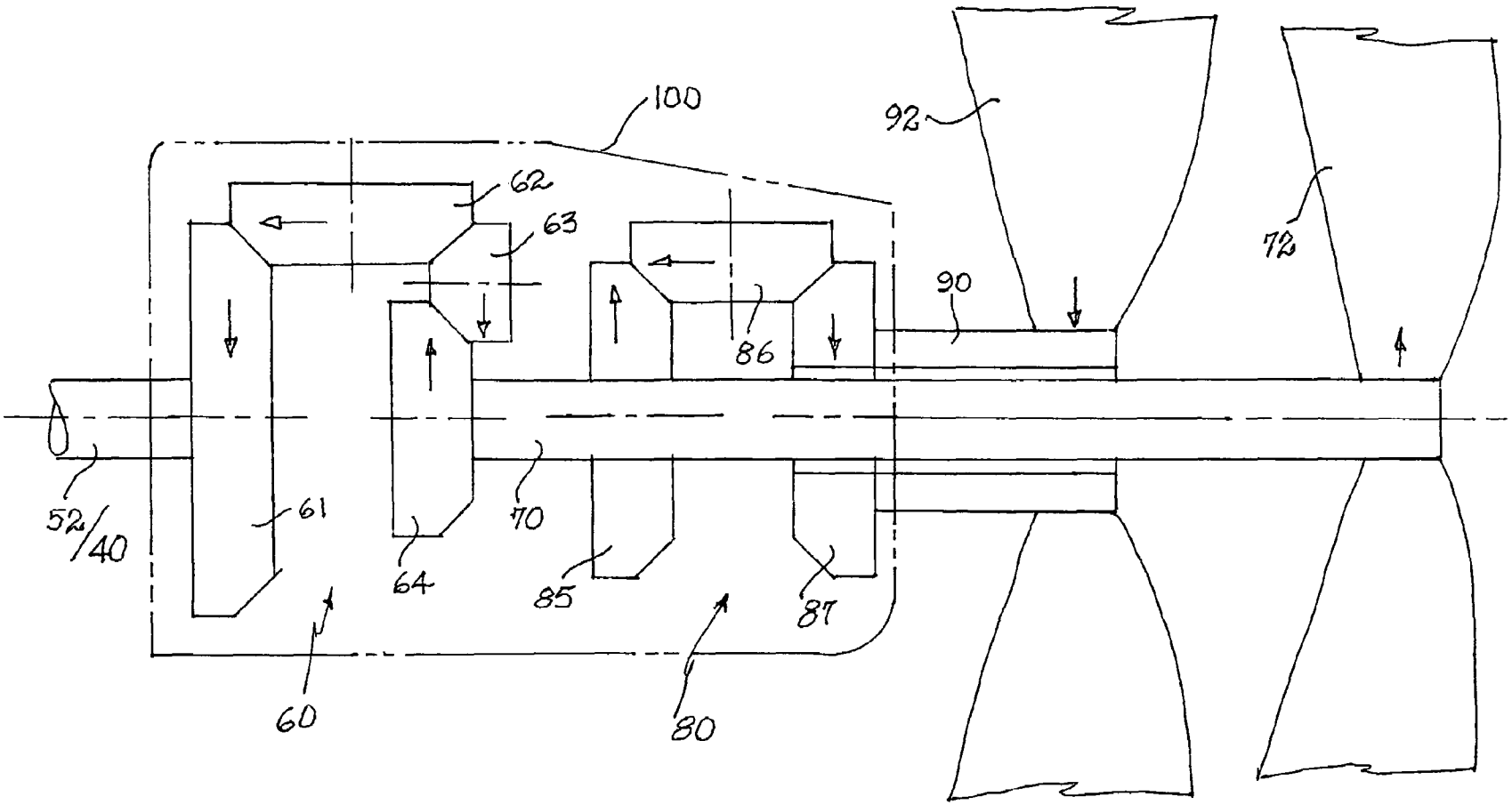

Illustrated in the accompanying drawing(s) is at least one of the best mode embodiments of the present invention In such drawing(s):

FIGS. 1 and 2 are schematic diagrams of the presently described apparatus as viewed from one side with FIG. 1 showing a low water line and FIG. 2 showing a high water line; and FIG. 3 is a detailed schematic of a gear system thereof, also as viewed from one side.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Described now in detail and shown in FIG. 1 is a marine drive apparatus 5 adapted for being engaged with and driven by an engine drive shaft 10 of a vessel. The vessel's hull 20 is penetrated by the engine drive shaft 10 which then extends rearwardly relative to the hull 20.

Referring still to FIG. 1, it is shown that the drive apparatus 5 includes a first universal joint 30 which is adapted by bracket 32 for securement to the hull 20 and receives the drive shaft 10 for rotation. As shown in this figure, shaft 10 extends from hull 20 at a downward angle as is conventional, yet first screw shaft 40 needs to be placed at a more nearly horizontal orientation. Therefore, joint 30 enables driving force to change direction between shafts 10 and 40. Universal joints are well known in marine drive systems, for instance in providing changes in the angle of attack of the vessel's screws. A double Cardan universal joint is preferably used as described in the Sage reference shown above. The first screw shaft 40 supports a first screw 42 and, in one embodiment, as shown in FIG. 1, it is engaged with a second universal joint 50 secured by bracket 52 to hull 20 and driven by the first screw shaft 40. Clearly then, in the embodiment shown in FIG. 1, screw 42 is able to maintain its, more or less, horizontal attitude producing forward thrust $V_F$ an optimal vector for producing forward thrust, while, by adjusting joint 50, screws 72 and 92 are able to be set at an angle of attack that will optimize lift vector $V_L$.

In FIG. 2 we see that the hull is set at greater depth thereby displacing a larger bow wave as the vectors $V_F$ and $V_L$ are collinear. Also in this figure we see that all three screws 42, 72 and 92 are always coaxial since joint 50 is not used.

As shown now in FIG. 3, a first gear set 60 is driven by a shaft 52 of the second universal joint 50 which, in turn, drives a second screw shaft 70. A second gear set 80 is driven by the second screw shaft 70. A third screw shaft 90 is driven by the second gear set 80 and supports the third screw 92. The second screw 72 is supported by the second screw shaft 70 at its terminal end. The first and second gear sets 60, 80 are enclosed within a water-tight enclosure 100 and the second and third screw shafts 70 and 90 as well as a shaft 52 of the second universal joint 50, penetrate the enclosure 100 through water tight rotational seals which are well known in the art and not depicted in the figures. In an alternate embodiment, the second universal joint 50 is not used, and in this case, the first screw shaft 40 penetrates the enclosure 100 through the water tight rotational seal. In FIG. 3 bearing sets and supports for the bearing sets are not shown as this detail is considered to fall under routine engineering practice and such detail would not provide an improvement to the concepts presented but would add unnecessary detail and confusion in FIG. 3.

The arrows shown on the several gears and shafts in FIG. 3 indicate their rotational sense. The gear enablements shown in this description are bevel gears, but different gear types and arrangements may be substituted by those of skill in the art. The first gear set 60 enables rotational speed differentiation between the first 40 and second 70 screw shafts so that screws 72 and 92 may be operated at a higher or lower rotational speed than screw 42. This has been found to be greatly beneficial as screws 72 and 92 are functional for driving hull 20 to sit higher in the water for planing or near planing operation so as to thereby achieve higher hull speed for improved fuel economy. The function of initially lifting the hull 20 for planing operation requires significant thrust, but after reaching a higher hull speed and planing operation, the angle of attack of screws 72 and 92 may preferably be brought near level so as to better contribute to the forward thrust of the vessel. The second gear set 80 enables opposing rotational directions for the second 70 and third 90 screw shafts. It is clear from FIG. 3 that the second 70 and third 90 screw shafts are arranged and rotate coaxially. In the alternate embodiment, the universal joint 50 is not used, so that the first screw shaft 40 is also aligned coaxially with the second 70 and third 90 screw shafts and screws 42, 72 and 92 are also coaxially aligned and change their angle of attack at the same time as driven by actuator 120.

Referring still to FIG. 3 the first gear set 60 comprises a first gear 61 driven by the second universal joint 50 in one embodiment, or by the first screw shaft 40 in another embodiment. The first gear 61 is engaged with a second gear 62 which is engaged with a third gear 63, which is engaged with a fourth gear 64, wherein the first 61 and fourth 64 gears rotate coaxially at different rotational speeds depending on the number of gear teeth in each of the gears 61, 62, 63, and 64.

The second gear set 80 comprises a fifth gear 85 driven by the fourth gear 64 and a sixth gear 86 driven by the fifth gear 85, and a seventh gear 87 driven by the sixth gear 86. As shown, the fifth 85 and seventh 87 gears are in coaxial rotation but rotate in opposing senses.

An actuator 120 is engaged with the enclosure 100 and is adapted for securement to the hull 20 by bracket 122. The actuator 120 is positioned and adapted for changing an angle of attack of the second 70 and third 90 screw shafts and, by that, the second 72 and third 92 screws. The actuator 120 and its arrangement relative to the hull and the enclosure 100 may be in accordance with FIGS. 1 and 2 of the McCormick U.S. Pat. No. 4,790,782, or FIG. 5 of the Sage U.S. Pat. No. 6,431,927, or FIGS. 1-13 of the Arneson U.S. Pat. No. 4,645,463, all of which patents are hereby incorporated by reference herein as general teachings of the physical and operational enablements of marine screw angle of attack adjustment.

It should be recognized that one embodiment of the present invention may include only screws 72 and 92 in FIG. 1 or FIG. 2 but not screw 42, although this is a less effective solution to the above described problem. Also, in a still further embodiment, the enclosure 100 may be fixed to the hull 20 without possibility of adjusting it angle of attack. In this approach, the angle of attack of screws 72 and 92 are fixed at a suboptimal position that can provide an optimal solution for the forward thrust vector $V_F$, or an optimal solution for the lift thrust vector $V_L$, but not both since screw 42 is not used.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments.

Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A marine drive apparatus adapted for being engaged with and driven by an engine drive shaft penetrating the hull of a vessel, the apparatus comprising and mutually engaged in a sequence of: a universal joint adapted to be secured to the hull; a first screw shaft supporting a first screw; a first gear set driven by the first screw shaft; a second screw shaft driven by the first gear set; a second gear set driven by the second screw shaft; a third screw shaft driven by the second gear set and supporting a third screw; and a second screw supported by the second screw shaft at a terminal end thereof; the first and second gear sets enclosed within a water-tight enclosure; the first gear set enabling rotational speed differentiation between the first and second screw shafts; the second gear set enabling rotational sense reversal between the second and third screw shafts; the apparatus further comprising an actuator engaged with the enclosure and adapted for securement to the hull, the actuator positioned and adapted for changing an angle of attack of the first, second and third screws.

2. The apparatus of claim 1 wherein the first gear set comprises a first, second, third and fourth gears in mutual rotational engagement, the first gear driven by the first screw shaft, the first and fourth gears rotating coaxially at differential rotational speeds.

3. The apparatus of claim 2 wherein the second gear set comprises a fifth, sixth and seventh gears in mutual rotational engagement, the fifth gear driven by the fourth gear, the fifth and seventh gears rotating coaxially in opposing rotational senses.

4. A marine drive apparatus adapted for being engaged with and driven by an engine drive shaft penetrating the hull of a vessel, the apparatus comprising and mutually engaged in a sequence of:

a first universal joint adapted for securement to the hull; a first screw shaft supporting a first screw; a second universal joint driven by the first screw shaft; a first gear set driven by a shaft of the second universal joint; a second screw shaft driven by the first gear set; a second gear set driven by the second screw shaft; a third screw shaft driven by the second gear set and supporting a third screw; and a second screw supported by the second screw shaft at a terminal end thereof; the first and second gear sets enclosed within a water-tight enclosure; the first gear set enabling rotational speed differentiation between the first and second screw shafts; the second gear set enabling rotational sense reversal of the third screw shaft relative to the second screw shaft; and the apparatus further comprising an actuator engaged with the enclosure and adapted for securement to the hull, the actuator positioned and adapted for changing an angle of attack of the second and third screws.

5. The apparatus of claim 4 wherein the first gear set comprises a first, second, third and fourth gears in mutual rotational engagement, the first gear driven by the first screw shaft, the first and fourth gears rotating coaxially at differential rotational speeds.

6. The apparatus of claim 5 wherein the second gear set comprises a fifth, sixth and seventh gears in mutual rotational engagement, the fifth gear driven by the fourth gear, the fifth and seventh gears rotating coaxially in opposing rotational senses.

7. A marine drive apparatus adapted for being engaged with and driven by a single engine drive shaft penetrating the hull of a vessel, the apparatus comprising: a second universal joint secured to the hull; a first gear set driven by a shaft of the second universal joint; a first screw shaft driven by a first universal joint; a second gear set driven by the first gear set; a second screw shaft driven by the first gear set and supporting a second screw; and a first screw supported by the first screw shaft; the first and second gear sets, enclosed within a water-tight enclosure; the first gear set enabling rotational speed differentiation between the first and second screw shafts; the second gear set enabling rotational sense reversal between the second and a third screw shafts; the apparatus further comprising an actuator engaged with the enclosure and secured to the hull, the actuator positioned and adapted for changing an angle of attack of the second and third screws.

8. The apparatus of claim 7 wherein the first gear set comprises a first, second, third and fourth gears in mutual rotational engagement, the first and fourth gears rotating coaxially at differential rotational speeds.

9. The apparatus of claim 8 wherein the second gear set comprises a fifth, sixth and seventh gears in mutual rotational engagement, the fifth gear driven by the fourth gear, the fifth and seventh gears rotating coaxially in opposing rotational senses.

10. A marine drive apparatus adapted for being engaged with and driven by an engine drive shaft penetrating the hull of a vessel, the apparatus comprising and mutually engaged in a sequence of:

a first universal joint adapted for securement to the hull; a first screw shaft supporting a first screw; a second universal joint driven by the first screw shaft; a first gear set driven by a shaft of the second universal joint; a second screw shaft driven by the first gear set; a second gear set driven by the second screw shaft; a third screw shaft driven by the second gear set and supporting a third screw; and a second screw supported by the second screw shaft at a terminal end thereof; the first and second gear sets enclosed within a water-tight enclosure; the first gear set enabling rotational speed differentiation between the first and second screw shafts; and the second gear set enabling rotational sense reversal of the third screw shaft relative to the second screw shaft.

11. The apparatus of claim 10 wherein the first gear set comprises a first, second, third and fourth gears in mutual rotational engagement, the first gear driven by the first screw shaft, the first and fourth gears rotating coaxially at differential rotational speeds.

12. The apparatus of claim 11 wherein the second gear set comprises a fifth, sixth and seventh gears in mutual rotational engagement, the fifth gear driven by the fourth gear, the fifth and seventh gears rotating coaxially in opposing rotational senses.

* * * * *